US006652607B2

(12) United States Patent
Langer et al.

(10) Patent No.: US 6,652,607 B2
(45) **Date of Patent: *Nov. 25, 2003**

(54) CONCENTRATED EMULSION FOR MAKING AN AQUEOUS HYDROCARBON FUEL

(75) Inventors: Deborah A. Langer, Chesterland, OH (US); John J. Mullay, Mentor, OH (US); Jennifer N. Fakult, Willoughby Hills, OH (US); Harshida C. Daves, Highland Heights, OH (US); William E. Skoch, Chardon, OH (US); David L. Westfall, Lakewood, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 419 days.

This patent is subject to a terminal disclaimer.

(21) Appl. No.: 09/731,309

(22) Filed: Dec. 6, 2000

(65) Prior Publication Data

US 2001/0005955 A1 Jul. 5, 2001

Related U.S. Application Data

(63) Continuation-in-part of application No. 09/483,481, filed on Jan. 14, 2000, now Pat. No. 6,383,237, which is a continuation-in-part of application No. 09/390,925, filed on Sep. 7, 1999, now Pat. No. 6,368,367, which is a continuation-in-part of application No. 09/349,268, filed on Jul. 7, 1999, now Pat. No. 6,368,366.

(51) Int. Cl.[7] ..... C10L 1/32

(52) U.S. Cl. ..... 44/301; 44/302; 44/325; 44/326; 44/331; 44/386

(58) Field of Search ..... 44/301

(56) References Cited

U.S. PATENT DOCUMENTS

| | | | | |
|---|---|---|---|---|
| 2,619,330 | A | 11/1952 | Willems | 259/96 |
| 2,858,200 | A | 10/1958 | Broughten | 44/57 |
| 3,408,308 | A | 10/1968 | Waterman et al. | 252/401 |
| 3,499,632 | A | 3/1970 | Piros | 259/4 |
| 3,756,794 | A | 9/1973 | Ford | 44/51 |
| 3,818,876 | A | 6/1974 | Voogd | 123/25 R |
| 3,855,103 | A | 12/1974 | McLaren et al. | 204/306 |
| 3,876,391 | A | 4/1975 | McCoy et al. | 44/51 |
| 4,048,080 | A | 9/1977 | Lee et al. | 252/515 A |
| 4,084,940 | A | 4/1978 | Lissant | 44/51 |
| 4,093,542 | A | 6/1978 | Dahmen et al. | 210/54 |
| 4,146,499 | A | 3/1979 | Rosano | 252/186 |
| 4,207,078 | A | 6/1980 | Sweeney et al. | 44/68 |
| 4,329,249 | A | 5/1982 | Forsberg | 252/34.7 |
| 4,388,893 | A | 6/1983 | Apfel | 123/255 |
| 4,433,917 | A | 2/1984 | Mendel et al. | 366/132 |
| 4,438,731 | A | 3/1984 | Maggio | 123/25 N |
| 4,447,348 | A | 5/1984 | Forsberg | 252/75 |
| 4,452,712 | A | 6/1984 | Laemmle | 252/493 |
| 4,482,356 | A | 11/1984 | Hanlon | 44/57 |
| 4,561,861 | A | 12/1985 | Davis et al. | 44/51 |
| 4,585,461 | A | 4/1986 | Gorman | 44/53 |
| 4,613,341 | A | 9/1986 | Zaweski et al. | 44/51 |
| 4,621,927 | A | 11/1986 | Hiroi | 366/132 |
| 4,670,167 | A | 6/1987 | Bleeker et al. | 252/8.554 |
| 4,670,550 | A | 6/1987 | Bleeker et al. | 536/114 |
| 4,697,929 | A | 10/1987 | Muller | 366/97 |
| 4,708,753 | A | 11/1987 | Forsberg | 149/2 |
| 4,748,055 | A | 5/1988 | Landers et al. | 427/292 |
| 4,776,977 | A | 10/1988 | Taylor | 252/314 |
| 4,892,562 | A | 1/1990 | Bowers et al. | 44/67 |
| 4,908,154 | A | 3/1990 | Cook et al. | 252/314 |
| 4,916,631 | A | 4/1990 | Crain et al. | 364/502 |
| 4,938,606 | A | 7/1990 | Kunz | 366/134 |
| 4,953,097 | A | 8/1990 | Crain et al. | 364/502 |
| 4,981,757 | A | 1/1991 | Landers et al. | 428/450 |
| 4,983,319 | A | 1/1991 | Gregoli et al. | 252/314 |
| 4,986,858 | A | 1/1991 | Oliver et al. | 149/109.6 |
| 5,000,757 | A | 3/1991 | Puttock et al. | 44/301 |
| 5,024,697 | A | 6/1991 | Landers et al. | 106/14.13 |
| 5,104,621 | A | 4/1992 | Pfost et al. | 422/67 |
| 5,110,591 | A | 5/1992 | Williams | 424/195.1 |
| 5,279,626 | A | 1/1994 | Cunningham et al. | 44/331 |
| 5,352,377 | A | 10/1994 | Blain et al. | 252/51.5 R |
| 5,389,111 | A | 2/1995 | Nikanjam et al. | 44/300 |
| 5,389,112 | A | 2/1995 | Nikanjam et al. | 44/300 |
| 5,399,293 | A | 3/1995 | Nunez et al. | 252/314 |
| 5,404,841 | A | 4/1995 | Valentine | 123/25 E |
| 5,411,558 | A | 5/1995 | Taniguchi et al. | 44/301 |
| 5,445,656 | A | 8/1995 | Marelli | 44/301 |

(List continued on next page.)

FOREIGN PATENT DOCUMENTS

| | | | |
|---|---|---|---|
| AU | 711348 | 3/1997 | 1/32 |
| WO | WO 97/34969 | 3/1997 | 1/32 |
| WO | WO99/13028 | 3/1999 | |
| WO | WO 99/13029 | 3/1999 | |
| WO | WO 99/13030 | 3/1999 | |
| WO | WO 99/13031 | 3/1999 | |
| WO | WO 01/15740 | 3/2000 | |
| WO | WO 01/04239 A1 | 1/2001 | |

OTHER PUBLICATIONS

Search Report from corresponding PCT International Publication WO 02/046336 A3 dated Nov. 21, 2002.

Kady International; Continuous Flow Dispersion Mills; 2/98; 5 pages (brochure).

IKA, Inc.; Batch Mixers, A Closer Look (www.silverson-.com/btchmxr2.htm); Mar. 18, 1999 (printed from internet); 4 pages.

Sonic Corp.; Tri–Homo Colloid Mills, catalog TH980; 4 pages.

*Primary Examiner*—Ellen M. McAvoy
(74) *Attorney, Agent, or Firm*—Teresan W. Gilbert; Michael F. Esposito

(57) ABSTRACT

A process to make water-blended fuel by emulsifying the emulsifier in a portion of the fuel, then adding the water under high shear mixing to give a concentrated water fuel emulsion. The concentrated emulsion is then diluted with final portion of fuel using mixing or blending conditions resulting in an emulsified water blend fuel.

28 Claims, No Drawings

U.S. PATENT DOCUMENTS 5,454,964 A 10/1995 Blackborow et al. ..... 252/56 D
5,478,365 A 12/1995 Nikanjam et al. ..... 44/280
5,501,714 A 3/1996 Valentine et al. ..... 44/358
5,503,772 A 4/1996 Rivas et al. ..... 252/314
5,544,856 A 8/1996 King et al. ..... 251/129.08
5,556,574 A 9/1996 Rivas et al. ..... 252/311.5
5,563,189 A 10/1996 Hosokawa et al. ..... 523/322
5,584,326 A 12/1996 Galli ..... 141/83
5,622,920 A 4/1997 Rivas et al. ..... 507/232
5,624,999 A 4/1997 Lombardi et al. ..... 525/52
5,632,596 A 5/1997 Ross ..... 415/83
5,643,528 A 7/1997 Le Gras ..... 266/88
5,669,938 A 9/1997 Schwab ..... 44/301
5,682,842 A 11/1997 Coleman et al. ..... 123/25 C
5,693,106 A 12/1997 Peter-Hoblyn et al. ..... 44/301
5,706,896 A 1/1998 Tubel et al. ..... 166/313
5,743,922 A 4/1998 Peter-Hoblyn et al. ..... 44/301
5,746,783 A 5/1998 Compere et al. ..... 44/301
5,792,223 A 8/1998 Rivas et al. ..... 44/302
5,817,254 A 10/1998 Wadle et al. ..... 252/312
5,851,245 A 12/1998 Moriyama et al. ..... 44/301
5,862,315 A 1/1999 Glaser et al. ..... 395/182.09
5,863,301 A 1/1999 Grosso et al. ..... 44/301
5,868,201 A 2/1999 Bussear et al. ..... 166/53
5,873,916 A 2/1999 Cemenska et al. ..... 44/301
5,879,079 A 3/1999 Hohmann et al. ..... 366/151.1
5,879,419 A 3/1999 Moriyama et al. ..... 44/301
5,895,565 A 4/1999 Steininger et al. ..... 210/85
5,896,292 A 4/1999 Hosaka et al. ..... 364/468.15
6,280,485 B1 * 8/2001 Daly et al. ..... 44/301
6,368,366 B1 4/2002 Langer et al. ..... 44/301
6,368,367 B1 4/2002 Langer et al. ..... 44/301
6,383,237 B1 * 5/2002 Langer et al. ..... 44/301
6,530,964 B2 * 3/2003 Langer et al. ..... 44/301
2001/0005955 A1 7/2001 Langer et al. ..... 44/301

* cited by examiner

CONCENTRATED EMULSION FOR MAKING AN AQUEOUS HYDROCARBON FUEL

This is a continuation-in-part of U.S. application Ser. No. 09/483,481 filed Jan. 14, 2000, now U.S. Pat. No. 6,383,237; which is a continuation-in-part of U.S. application Ser. No. 09/390,925 filed Sep. 7, 1999, now U.S. Pat. No. 6,368,367; which is a continuation-in-part of U.S. application Ser. No. 09/349,268 filed Jul. 7, 1999 now U.S. Pat. No. 6,368,366. All of the disclosures in the prior applications are incorporated herein by reference in their entirety.

FIELD OF THE INVENTION

The invention relates to a concentrated emulsion for making an aqueous hydrocarbon fuel emulsion. More particular the invention relates to a process for making an aqueous hydrocarbon fuel involving the pre-emulsification of a concentrated emulsion that is then diluted by the external fuel phase.

BACKGROUND OF THE INVENTION

Diesel fueled engines produce NOx due to the relatively high flame temperatures reached during combustion. Nitrogen oxides are an environmental issue because they contribute to smog and pollution. Governmental regulation and environmental concerns have driven the need to reduce NOx emissions from engines. Non-attainment areas such as California and Houston and heavily regulated areas such as Mexico City, the UK, and Germany would most benefit by emissions reductions. The reduction of NOx production includes the use of catalytic converters, using "clean" fuels, recirculation of exhaust and engine timing changes. These methods are typically expensive or complicated to be commercially used.

Internal combustion engines, especially diesel engines, using water mixed with fuel in the combustion chamber can produce lower NOx, hydrocarbon and particulate emissions per unit of power output. Water is inert toward combustion, but lowers the peak combustion temperature resulting in reduced particulates and NOx formation. The water in fuel emulsion reduces the NOx emissions in diesel engines by approximately 5–20% and particulates 20–50%.

When water is added to the fuel it forms an emulsion and these emulsions are generally unstable. Stable water-in-fuel emulsions of small particle size are more difficult to reach and maintain. It would be advantageous to make a stable water-in-fuel emulsion that can be stable in storage.

It would be advantageous to produce a stable water-in-fuel emulsion that has optimum stability and at a good throughput rate. Applicant's current process disclosed in the prior applications listed above utilizes a process in which the total amount of water, fuel and emulsifiers are emulsified to produce a fully formulated aqueous hydrocarbon fuel emulsion. It has been discovered that adding a portion of the fuel initially with the total amount of water and total amount of emulsifiers to form a concentrated emulsion, and then later adding the final portion of fuel to the concentrated emulsion results in improved emulsion stability of the fully formulated water in fuel blend. Further, preparing a concentrated emulsion that is then diluted with the final portion of fuel, increases the throughput by allowing for the production of a greater quantity of fully formulated water-blended fuel product.

SUMMARY OF THE INVENTION

The invention relates to a concentrated aqueous hydrocarbon emulsion comprising:

(1) a portion of a total amount of a hydrocarbon fuel contained in the fully formulated aqueous hydrocarbon fuel emulsion, (2) substantially all of an emulsifier contained in the fully formulated aqueous hydrocarbon fuel emulsion wherein the emulsifier is selected from the group consisting of (i) at least one fuel-soluble product made by reacting at least one hydrocarbyl-substituted carboxylic acid acylating agent with ammonia or an amine, the hydrocarbyl-substituted acylating agent having about 50 to about 500 carbon atoms; (ii) at least one of an ionic or non-ionic compound having a hydrophilic-lipophilic balance of about 1 to about 40; (iii) a mixture of (i) and (ii); or (iv) a water-soluble compound selected from the group consisting of amine salts, ammonium, azide compounds, nitro compounds, nitrate esters, nitramine, alkali metal salts, alkaline earth metal salts and mixtures thereof in combinations with (i), (ii) or (iii); and (3) substantially all of a water contained in the fully formulated aqueous hydrocarbon fuel emulsion wherein the water is selected from the group consisting of water, water/antifreeze, water/ammonium nitrate, or combinations thereof, resulting in a concentrated aqueous hydrocarbon emulsion used to make the fully formulated aqueous hydrocarbon fuel emulsion.

The invention further relates to a process for the production of an aqueous hydrocarbon fuel emulsion from a concentrated aqueous hydrocarbon fuel emulsion comprising:

(1) preparing a concentrated aqueous hydrocarbon fuel emulsion comprising emulsifying;

(a) a portion of a hydrocarbon fuel in the range of about 0.5% to about 70% by weight in the fully formulated aqueous hydrocarbon fuel emulsion;

(b) substantially all of an emulsifier in the range of about 0.05% to about 20% by weight of the fully formulated aqueous hydrocarbon fuel emulsion wherein the emulsifier is selected from the group consisting of (i) at least one fuel-soluble product made by reacting at least one hydrocarbyl-substituted carboxylic acid acylating agent with ammonia or an amine, the hydrocarbyl-substituted acylating agent having about 50 to about 500 carbon atoms; (ii) at least one of an ionic or non-ionic compound having a hydrophilic-lipophilic balance of about 1 to about 40; (iii) a mixture of (i) and (ii); or (iv) a water-soluble compound selected from the group consisting of amine salts, ammonium salts, azide compounds, nitro compounds, nitrate esters, nitramine, alkali metal salts, alkaline earth metal salts and mixtures thereof in combination with (i), (ii) or (iii); and (c) substantially all of water in the range of about 5% to about 50% by weight of the fully formulated aqueous hydrocarbon fuel emulsion wherein the water is selected from the group consisting of water, water/antifreeze, water/ammonium nitrate, and combinations therein, to form a concentrated aqueous hydrocarbon fuel emulsion with a water particle size having a mean diameter of less than 1 micron;

(2) diluting the concentrated aqueous hydrocarbon fuel emulsion with the remaining portion of hydrocarbon fuel in the range of about 95% to about 50% by weight in the fully formulated aqueous hydrocarbon fuel emulsion, resulting in a fully formulated aqueous hydrocarbon fuel comprising about 50% to about 99% by weight liquid hydrocarbon fuel and about 1% to about 50% by weight water.

The invention further provides for a continuous or batch process for making a fully formulated aqueous hydrocarbon fuel emulsion from a concentrated aqueous hydrocarbon fuel emulsion.

SPECIFIC EMBODIMENT

The invention relates to a concentrated aqueous hydrocarbon fuel emulsion. The concentrated aqueous hydrocarbon fuel emulsion contains a portion of the total hydrocarbon fuel contained in the fully formulated aqueous hydrocarbon fuel emulsion. The portion of hydrocarbon fuel in the concentrated aqueous hydrocarbon emulsion is in the range of about 0.5% to about 70% by weight of the fully formulated aqueous hydrocarbon fuel emulsion, in another embodiment in the range of about 5% to about 40% by weight of the fully formulated aqueous hydrocarbon fuel emulsion, and in another embodiment, in the range of about 5% to about 20% by weight of the fully formulated aqueous hydrocarbon fuel emulsion.

The concentrated aqueous hydrocarbon emulsion contains the total amount of emulsion and in another embodiment substantially all of the emulsifier. A small amount of emulsifier may optionally be added to the fully formulated aqueous hydrocarbon fuel emulsion, the hydrocarbon fuel or combinations thereof. The emulsifier is in a range of about 0.05% to about 20% by weight of the fully formulated aqueous hydrocarbon fuel emulsion, in one embodiment in the range of about 0.1% to about 10% by weight of the fully formulated aqueous hydrocarbon emulsion, in another embodiment in the range of about 1% to about 10% by weight of the fully formulated aqueous hydrocarbon fuel emulsion, and in another embodiment in the range of about 1% to about 5% by weight of the fully formulated aqueous hydrocarbon fuel emulsion.

The emulsifier is selected from the group consisting of (i) at least one fuel-soluble product made by reacting at least one hydrocarbyl-substituted carboxylic acid acylating agent with ammonia or an amine, the hydrocarbyl-substituted acylating agent having about 50 to about 500 carbon atoms; (ii) at least one of an ionic or non-ionic compound having a hydrophilic-lipophilic balance of about 1 to about 40; (iii) a mixture of (i) and (ii); or (iv) a water-soluble compound selected from the group consisting of amine salts, ammonium salts, azide compounds, nitro compounds, nitrate esters, nitramine, alkali metal salts, alkaline earth metal salts and mixtures there in combinations with (i), (ii) or (iii).

The concentrated aqueous hydrocarbon emulsion contains the total amount of water and in another embodiment substantially all of the water. The water is in the range of about 1% to about 50% by weight of the fully formulated aqueous hydrocarbon fuel emulsion, in one embodiment in the range of about 15% to about 50% by weight of the fully formulated aqueous hydrocarbon fuel emulsion, and in another embodiment in the range of about 35% to about 50% by weight of the fully formulated aqueous hydrocarbon fuel emulsion. The water is selected from the group consisting of water, water antifreeze, water ammonium nitrate or combinations thereof. A small amount of may be added to the fully formulated aqueous hydrocarbon emulsifier, the hydrocarbon fuel or combinations thereof.

The concentrated aqueous hydrocarbon emulsion has a shelf life at ambient conditions for at least one year, and in another embodiment for greater than one year.

The invention further relates to a process for the production of an aqueous hydrocarbon fuel from the concentrated aqueous hydrocarbon fuel emulsion. The concentrated aqueous hydrocarbon emulsion contains a portion of the total hydrocarbon fuel contained in the fully formulated aqueous hydrocarbon fuel emulsion. The process involves preparing the concentrated aqueous hydrocarbon fuel emulsion. A portion of the hydrocarbon fuel is emulsified with the total quantity of emulsifier and the total quantity of water in the fully formulated aqueous hydrocarbon fuel emulsion. The portion of hydrocarbon fuel added to make the concentrated aqueous hydrocarbon emulsion is in the range of about 5% to about 50%, in another embodiment in the range of about 5% to about 40%, and in another embodiment in the range of about 1% to about 20% by weight of the fully formulated aqueous hydrocarbon fuel emulsion.

Substantially all of the emulsifier is added to the portion of hydrocarbon fuel. Small amounts of emulsifier may optionally be added to the fully formulated aqueous hydrocarbon emulsion, the hydrocarbon fuel or combination thereof. The emulsifier is in the range of about 0.05% to about 20%, in another embodiment about 0.1% to about 10%, and in another embodiment about 0.5% to about 5% by weight of the formulated aqueous hydrocarbon fuel product.

Optionally, additives may be added to the emulsifier, the fuel, the water or combinations thereof dependent upon the solubility of the additives. The additives include but are not limited to cetane improvers, organic solvents, antifreeze agents, stabilizers, surfactants, other additives known for their use in fuel and the like. The additives are added to the emulsifier, hydrocarbon fuel or the water prior to or in the alternative during emulsification or, in another embodiment, top treated to the fully formulated emulsion. The additives are generally in the range of about 0.00001% to about 10% by weight, in another embodiment about 0.0001% to about 10% by weight, and in another embodiment about 0.001% to about 10% by weight of the fully formulated aqueous hydrocarbon fuel emulsion.

The hydrocarbon fuel, the emulsifier and/or the additives are then emulsified with the total quantity of water, and in another embodiment substantially all of the water, resulting in a concentrated aqueous hydrocarbon emulsion. The water is added in the range of about 5% to about 50%, in another embodiment about 15% to about 50%, and in another embodiment about 35% to about 50% by weight of the fully formulated aqueous hydrocarbon fuel emulsion. A small amount of water may be added to the fully formulated aqueous hydrocarbon emulsifier, the hydrocarbon fuel or combinations thereof.

The water can optionally include but is not limited to antifreeze, ammonium nitrate or mixtures thereof. The ammonium nitrate is generally added to the water mixture as aqueous solution and in another embodiment it is added to the emulsifier. The water is added with high shear mixing/emulsification to form the concentrated emulsion.

Emulsification occurs by any known process. The emulsification generally occurs under ambient conditions. The emulsification results in the concentrated aqueous hydrocarbon emulsion having a mean particle droplet size less than or equal to 1 micron, in one embodiment in the range of about of 0.1 micron to about 1 micron, in another embodiment in the range of about 0.1 to about 0.95, in another embodiment in the range of about 0.1 to about 0.8, and in another embodiment in the range of about 0.1 to about 0.7. The emulsification occurs under sufficient conditions to provide such mean droplet particles sizes.

Shearing is a crucial step in producing the aqueous hydrocarbon fuel. Two things generally occur during emulsification; the water is broken up into homogeneous submicron particle sizes and the emulsifier is distributed to the aqueous interface so as to stabilize the particle size distribution. The entire water portion and entire emulsifier portion are present during emulsification for the fully formulated aqueous hydrocarbon fuel emulsion to be homogeneous and exhibit improved stability.

Only a fraction of the total fuel is present during emulsification. The concentrated aqueous hydrocarbon emulsion is then diluted with the balance of hydrocarbon fuel portion. The dilution can occur by any general method known in the art such as mixing, blending, agitation, stirring, emulsification and the like. High shearing is not necessary but is optional. The final portion of hydrocarbon fuel is in the range of about 40% to about 95%, in another embodiment about 50% to about 95%, and in another embodiment about 70% to about 95% by weight of the fully formulated aqueous hydrocarbon fuel emulsion. The portion of hydrocarbon fuel blended with the concentrated aqueous hydrocarbon emulsion equals the difference between the total amount of hydrocarbon fuel in the fully formulated aqueous hydrocarbon fuel emulsion and the portion of hydrocarbon fuel contained in the concentrated aqueous hydrocarbon fuel emulsion. The less hydrocarbon fuel added up front, the larger final product throughput after the balance of the fuel is added.

In the practice of the present invention the aqueous hydrocarbon fuel emulsion is made by a batch or a continuous process. The process is capable of monitoring and adjusting the flow rates of the fuel, emulsifier, additives and/or water to form a stable emulsion with the desired water droplet size.

In a batch process all the water, all the emulsifier and a portion of hydrocarbon fuel is used generally at the shear tank capacity. The batch process of making the concentrate increases the throughput of the fully formulated aqueous hydrocarbon fuel emulsion. The more concentrated the aqueous hydrocarbon emulsion formulizations result in higher batch throughput because of the incremental increase in time cycle is less than the proportional increase in time cycle in fully formulated batch size. For water concentrated processing, batch time is minimized by separating the emulsification phase from the dilution-blending phase. This enables the two processes to occur simultaneously. In another embodiment the concentrated aqueous hydrocarbon fuel emulsion can at a later time be blended with the final portion of fuel. The fully formulated emulsion from the concentrated emulsification gives a significantly more stable product than conventional processing.

The concentrated emulsion can also be prepared in a continuous process and demonstrates equal or greater stability performance than the current approaches. There is an increased throughput by using a continuous process. The continuous process eliminates the need for additional time that is needed in batch processing multiple tank turnovers.

The process may be in the form of a containerized equipment unit that operates automatically. The process can be programmed and monitored locally at the site of its installation, or it can be programmed and monitored from a location remote from the site of its installation. The fully formulated water fuel blend is optionally dispensed to end users at the installation site, or in another embodiment end users can blend the concentrated emulsion with the final portion of fuel. This provides a way to make the aqueous hydrocarbon fuel emulsions available to end users in wide distribution networks.

It is clear that more water concentrated aqueous hydrocarbon emulsification results in higher batch throughput for the incremental increase in time cycle is less than proportional to the increase in final batch size. For water concentrated processing, batch time is minimized by separating the emulsification phase from the dilution blending phase.

EXAMPLE I

The inventive process utilized the below formulation; however, only a portion of the diesel fuel in the initial mixture was emulsified with the emulsifier and the water. The water was added with high shear mixing to form the aqueous hydrocarbon emulsion. The final portion of the diesel fuel was then added without further high shear agitation.

The "Emulsified Fuel" represents that portion of the fuel that was mixed with the other components to make a concentrated aqueous hydrocarbon emulsion. The "Fuel added" portion was then blended with the concentrated aqueous hydrocarbon emulsion.

Viscosity was measured in seconds in a Zahn cup.

| Component A | Weight Percent |
|---|---|
| LZ2825 (0729.1)* | 1.200 |
| Surfactant I** | 0.214 |
| Surfactant II*** | 0.594 |
| 2-Ethylhexylnitrate | 0.714 |
| Ammonium Nitrate | 0.278 |

*The reaction product of 200 mol. wt PIB succinic anhydride and dimethylethanol amine in an equivalent weight ratio of 1:1.
**The reaction product of hexadecyl succinic anhydride with dimethylethanolamine at a mole ratio of 1:1.
***A polyamine derivative of polyisobutylene succinic anhydride.

| PROCESS | Conventional Emulsifiction | | Concentrated Emulsification with Diesel Dilution Blending | | | | | |
|---|---|---|---|---|---|---|---|---|
| NAME | A | | B | | C | | D | |
| Component | pbw* | gallons | pbw* | gallons | pbw* | gallons | pbw* | gallons |
| Initial Diesel | 77 | 79.7 | 10 | 33.8 | 20 | 50.4 | 30 | 60.5 |
| Component A | 3 | 2.7 | 3 | 8.9 | 3 | 6.7 | 3 | 5.3 |
| Water | 20 | 17.6 | 20 | 57.3 | 20 | 42.9 | 20 | 34.2 |
| Emulsified Fuel | 100 | 100 | | 100 | | 100 | | 100 |
| Fuel Added | 0 | 0 | 67 | 226 | 57 | 144 | 47 | 95 |
| FINAL BATCH SIZE | 100 | 100 | 100 | 326 | 100 | 244 | 100 | 195 |

*pbw formulation is per 100 parts finished water-blend fuel.

This Example demonstrates that throughputs increasing by using the concentrated emulsion processed in a 100-gallon blend tank is 3× greater than throughput without using a concentrated emulsion.

This process compared to one in which all of the fuel is present from the start has the advantages of being faster, producing more product and producing higher quality (more homogeneous and more stable) aqueous hydrocarbon fuel emulsions. This is accomplished primarily because the emulsifiers in the emulsification step are more concentrated and thus more effective at forming emulsions in spite of the higher amount of water relative to the fuel.

The Engines

The engines that may be operated in accordance with the invention include all compression-ignition (internal combustion) engines for both mobile (including marine) and stationary power plants including but not limited to diesel, gasoline, and the like. The engines that can be used include but are not limited to those used in automobiles, trucks such as all classes of truck, buses such as urban buses, locomotives, heavy duty diesel engines, stationary engines (how define) and the like. Included are on- and off-highway engines, including new engines as well as in-use engines. These include diesel engines of the two-stroke-per-cycle and four-stroke-per-cycle types.

The Water Fuel Emulsions

In one embodiment, the water fuel emulsions are comprised of: a continuous fuel phase; discontinuous water or aqueous phase; and an emulsifying amount of an emulsifier. The emulsions may contain other additives that include but are not limited to cetane improvers, organic solvents, antifreeze agents, and the like. These emulsions may be prepared by the steps of (1) mixing the fuel, emulsifier and other desired additives using standard mixing techniques to form a hydrocarbon fuel/additives mixture; and (2) mixing the hydrocarbon fuel/additives mixture with water (and optionally an antifreeze agent) under emulsification conditions to form the desired aqueous hydrocarbon fuel emulsion. Alternatively, the water-soluble compounds (iii) used in the emulsifier can be mixed with the water prior to the high-shear mixing.

The water or aqueous phase of the aqueous hydrocarbon fuel emulsion is comprised of droplets having a mean diameter of 1.0 micron or less. Thus, the emulsification generally occurs by shear mixing and is conducted under sufficient conditions to provide such a droplet size.

The Liquid Hydrocarbon Fuel

The liquid hydrocarbon fuel comprises hydrocarbonaceous petroleum distillate fuel, non-hydrocarbonaceous water, oils, liquid fuels derived from vegetables, liquid fuels derived from mineral and mixtures thereof. The liquid hydrocarbon fuel may be any and all hydrocarbonaceous petroleum distillate fuels including not limited to motor gasoline as defined by ASTM Specification D439 or diesel fuel or fuel oil as defined by ASTM Specification D396 or the like (kerosene, naphtha, aliphatics and paraffinics). The liquid hydrocarbon fuels comprising non-hydrocarbonaceous materials include but are not limited to alcohols such as methanol, ethanol and the like, ethers such as diethyl ether, methyl ethyl ether and the like, organo-nitro compounds and the like; liquid fuels derived from vegetable or mineral sources such as corn, alfalfa, shale, coal and the like. The liquid hydrocarbon fuels also include mixtures of one or more hydrocarbonaceous fuels and one or more non-hydrocarbonaceous materials. Examples of such mixtures are combinations of gasoline and ethanol and of diesel fuel and ether. In one embodiment, the liquid hydrocarbon fuel is any gasoline. Generally, gasoline is a mixture of hydrocarbons having an ASTM distillation range from about 60° C. at the 10% distillation point to about 205° C. at the 90% distillation point. In one embodiment, the gasoline is a chlorine-free or low-chlorine gasoline characterized by a chlorine content of no more than about 10 ppm.

In one embodiment, the liquid hydrocarbon fuel is any diesel fuel. Diesel fuels typically have a 90% point distillation temperature in the range of about 300° C. to about 390° C., and in one embodiment about 330° C. to about 350° C. The viscosity for these fuels typically ranges from about 1.3 to about 24 centistokes at 40° C. The diesel fuels can be classified as any of Grade Nos. 1-D, 2-D or 4-D as specified in ASTM D975. The diesel fuels may contain alcohols and esters. In one embodiment the diesel fuel has a sulfur content of up to about 0.05% by weight (low-sulfur diesel fuel) as determined by the test method specified in ASTM D2622-87. In one embodiment, the diesel fuel is a chlorine-free or low-chlorine diesel fuel characterized by chlorine content of no more than about 10 ppm.

The liquid hydrocarbon fuel is present in the aqueous hydrocarbon fuel emulsion at a concentration of about 50% to about 95% by weight, and in one embodiment about 60% to about 95% by weight, and in one embodiment about 65% to about 85% by weight, and in one embodiment about 70% to about 80% by weight.

The Water

The water used in forming the aqueous hydrocarbon fuel emulsions may be taken from any source. The water includes but is not limited to tap, deionized, demineralized, purified, for example, using reverse osmosis or distillation, and the like.

The water may be present in the final aqueous hydrocarbon fuel emulsions at a concentration of about 1% to about 50% by weight, and in one embodiment about 5% to about 50% by weight, and in one embodiment about 5% to about 40% by weight, and in one embodiment about 5% to about 25% by weight, and in one embodiment 15% to about 50% by weight, and in one embodiment about 35% to about 50% by weight, and in one embodiment about 10% to about 20% by weight.

The Emulsifier

The emulsifier is comprised of: (i) at least one fuel-soluble product made by reacting at least one hydrocarbyl-substituted carboxylic acid acylating agent with ammonia or an amine, the hydrocarbyl substituent of said acylating agent having about 50 to about 500 carbon atoms; (ii) at least one of an ionic or a nonionic compound having a hydrophilic-lipophilic balance (HLB) in one embodiment of about 1 to about 40; in one embodiment about 1 to about 30, in one embodiment about 1 to about 20, and in one embodiment about 1 to about 15; (iii) a mixture of (i) and (ii); or (iv) a water-soluble compound selected from the group consisting of amine salts, ammonium salts, azide compounds, nitro compounds, alkali metal salts, alkaline earth metal salts and mixtures thereof in combination of with (i), (ii) or (iii). The emulsifier may be present in the water fuel emulsion at a concentration of about 0.05% to about 20% by weight, and in one embodiment about 0.05% to about 10% by weight, and in one embodiment about 0.1% to about 5% by weight, and in one embodiment about 0.1% to about 3% by weight.

The Fuel-Soluble Product (i)

The fuel-soluble product (i) may be at least one fuel-soluble product made by reacting at least one hydrocarbyl-substituted carboxylic acid acylating agent with ammonia or an amine, the hydrocarbyl substituent of said acylating agent having about 50 to about 500 carbon atoms.

The hydrocarbyl-substituted carboxylic acid acylating agents may be carboxylic acids or reactive equivalents of such acids. The reactive equivalents may be an acid halides, anhydrides, or esters, including partial esters and the like. The hydrocarbyl substituents for these carboxylic acid acylating agents may contain from about 50 to about 500 carbon atoms, and in one embodiment about 50 to about 300 carbon atoms, and in one embodiment about 60 to about 200 carbon atoms. In one embodiment, the hydrocarbyl substituents of these acylating agents have number average molecular weights of about 700 to about 3000, and in one embodiment about 900 to about 2300.

The hydrocarbyl-substituted carboxylic acid acylating agents may be made by reacting one or more alpha-beta olefinically unsaturated carboxylic acid reagents containing 2 to about 20 carbon atoms, exclusive of the carboxyl groups, with one or more olefin polymers as described more fully hereinafter.

The alpha-beta olefinically unsaturated carboxylic acid reagents may be either monobasic or polybasic in nature. Exemplary of the monobasic alpha-beta olefinically unsaturated carboxylic acid include the carboxylic acids corresponding to the formula

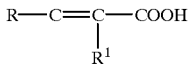

wherein R is hydrogen, or a saturated aliphatic or alicyclic, aryl, alkylaryl or heterocyclic group, preferably hydrogen or a lower alkyl group, and $R^1$ is hydrogen or a lower alkyl group. The total number of carbon atoms in R and $R^1$ typically does not exceed about 18 carbon atoms. Specific examples of useful monobasic alpha-beta olefinically unsaturated carboxylic acids include acrylic acid; methacrylic acid; cinnamic acid; crotonic acid; 3-phenyl propenoic acid; alpha, and beta-decenoic acid. The polybasic acid reagents are preferably dicarboxylic, although tri- and tetracarboxylic acids can be used. Exemplary polybasic acids include maleic acid, fumaric acid, mesaconic acid, itaconic acid and citraconic acid. Reactive equivalents of the alpha-beta olefinically unsaturated carboxylic acid reagents include the anhydride, ester or amide functional derivatives of the foregoing acids. A useful reactive equivalent is maleic anhydride.

The olefin monomers from which the olefin polymers may be derived are polymerizable olefin monomers characterized by having one or more ethylenic unsaturated groups. They may be monoolefinic monomers such as ethylene, propylene, 1-butene, isobutene and 1-octene or polyolefinic monomers (usually di-olefinic monomers such as 1,3-butadiene and isoprene). Usually these monomers are terminal olefins, that is, olefins characterized by the presence of the group>C=$CH_2$. However, certain internal olefins can also serve as monomers (these are sometimes referred to as medial olefins). When such medial olefin monomers are used, they normally are employed in combination with terminal olefins to produce olefin polymers that are interpolymers. Although, the olefin polymers may also include aromatic groups (especially phenyl groups and lower alkyl and/or lower alkoxy-substituted phenyl groups such as para (tertiary-butyl)-phenyl groups) and alicyclic groups such as would be obtained from polymerizable cyclic olefins or alicyclic-substituted polymerizable cyclic olefins, the olefin polymers are usually free from such groups. Nevertheless, olefin polymers derived from such interpolymers of both 1,3-dienes and styrenes such as 1,3-butadiene and styrene or para-(tertiary butyl) styrene are exceptions to this general rule. In one embodiment, the olefin polymer is a partially hydrogenated polymer derived from one or more dienes. Generally the olefin polymers are homo- or interpolymers of terminal hydrocarbyl olefins of about 2 to about 30 carbon atoms, and in one embodiment about 2 to about 16 carbon atoms. A more typical class of olefin polymers is selected from that group consisting of homo- and interpolymers of terminal olefins of 2 to about 6 carbon atoms, and in one embodiment 2 to about 4 carbon atoms.

Specific examples of terminal and medial olefin monomers which can be used to prepare the olefin polymers include ethylene, propylene, 1-butene, 2-butene, isobutene, 1-pentene, 1-hexene, 1-heptene, 1-octene, 1-nonene, 1-decene, 2-pentene, propylene tetramer, diisobutylene, isobutylene trimer, 1,2-butadiene, 1,3-butadiene, 1,2-pentadiene, 1,3-pentadiene, isoprene, 1,5-hexadiene, 2-chloro 1,3-butadiene, 2-methyl-1-heptene, 3-cyclohexyl-1 butene, 3,3-dimethyl 1-pentene, styrene, divinylbenzene, vinyl-acetate, allyl alcohol, 1-methylvinylacetate, acrylonitrile, ethyl acrylate, ethylvinylether and methylvinylketone. Of these, the purely hydrocarbon monomers are more typical and the terminal olefin monomers are especially useful.

In one embodiment, the olefin polymers are polyisobutenes such as those obtained by polymerization of a $C_4$ refinery stream having a butene content of about 35 to about 75% by weight and an isobutene content of about 30 to about 60% by weight in the presence of a Lewis acid catalyst such as aluminum chloride or boron trifluoride. These polyisobutenes generally contain predominantly (that is, greater than about 50% of the total repeat units) isobutene repeat units of the configuration

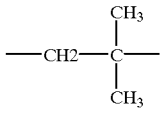

In one embodiment, the olefin polymer is a polyisobutene group (or polyisobutylene group) having a number average molecular weight of about 700 to about 3000, and in one embodiment about 900 to about 2300.

In one embodiment, the hydrocarbyl-substituted carboxylic acid acylating agent is a hydrocarbyl-substituted succinic acid or anhydride represented correspondingly by the formulae

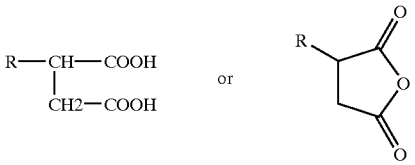

wherein R is hydrocarbyl group of about 50 to about 500 carbon atoms, and in one embodiment from about 50 to about 300, and in one embodiment from about 60 to about 200 carbon atoms. The production of these hydrocarbyl-substituted succinic acids or anhydrides via alkylation of maleic acid or anhydride or its derivatives with a halohydrocarbon or via reaction of maleic acid or anhydride with an olefin polymer having a terminal double bond is well known to those of skill in the art and need not be discussed in detail herein.

The hydrocarbyl-substituted carboxylic acid acylating agent may be a hydrocarbyl-substituted succinic acylating agent consisting of hydrocarbyl substituent groups and succinic groups. The hydrocarbyl substituent groups are derived from olefin polymers as discussed above. In one embodiment, the hydrocarbyl-substituted carboxylic acid acylating agent is characterized by the presence within its structure of an average of at least 1.3 succinic groups, and in one embodiment from about 1.3 to about 2.5, and in one embodiment about 1.5 to about 2.5, and in one embodiment from about 1.7 to about 2.1 succinic groups for each equivalent weight of the hydrocarbyl substituent. In one embodiment, the hydrocarbyl-substituted carboxylic acid acylating agent is characterized by the presence within its structure of about 1.0 to about 1.3, and in one embodiment about 1.0 to about 1.2, and in one embodiment from about 1.0 to about 1.1 succinic groups for each equivalent weight of the hydrocarbyl substituent.

In one embodiment, the hydrocarbyl-substituted carboxylic acid acylating agent is a polyisobutene-substituted succinic anhydride, the polyisobutene substituent having a number average molecular weight of about 1500 to about 3000, and in one embodiment about 1800 to about 2300, said first polyisobutene-substituted succinic anhydride being characterized by about 1.3 to about 2.5, and in one embodiment about 1.7 to about 2.1 succinic groups per equivalent weight of the polyisobutene substituent.

In one embodiment, the hydrocarbyl-substituted carboxylic acid acylating agent is a polyisobutene-substituted succinic anhydride, the polyisobutene substituent having a number average molecular weight of about 700 to about 1300, and in one embodiment about 800 to about 1000, said polyisobutene-substituted succinic anhydride being characterized by about 1.0 to about 1.3, and in one embodiment about 1.0 to about 1.2 succinic groups per equivalent weight of the polyisobutene substituent.

For purposes of this invention, the equivalent weight of the hydrocarbyl substituent group of the hydrocarbyl-substituted succinic acylating agent is deemed to be the number obtained by dividing the number average molecular weight (Me) of the polyolefin from which the hydrocarbyl substituent is derived into the total weight of all the hydrocarbyl substituent groups present in the hydrocarbyl-substituted succinic acylating agents. Thus, if a hydrocarbyl-substituted acylating agent is characterized by a total weight of all hydrocarbyl substituents of 40,000 and the $M_n$ value for the polyolefin from which the hydrocarbyl substituent groups are derived is 2000, then that substituted succinic acylating agent is characterized by a total of 20 (40,000/2000=20) equivalent weights of substituent groups.

The ratio of succinic groups to equivalent of substituent groups present in the hydrocarbyl-substituted succinic acylating agent (also called the "succination ratio") can be determined by one skilled in the art using conventional techniques (such as from saponification or acid numbers). For example, the formula below can be used to calculate the succination ratio where maleic anhydride is used in the acylation process:

$$SR = \frac{M_n \times (\text{Sap. No. of acylating agent})}{(56100 \times 2) - (98 \times \text{Sap. No. of acylating agent})}$$

In this equation, SR is the succination ratio, $M_n$ is the number average molecular weight, and Sap. No. is the saponification number. In the above equation, Sap. No. of acylating agent=measured Sap. No. of the final reaction mixture/AI wherein AI is the active ingredient content expressed as a number between 0 and 1, but not equal to zero. Thus an active ingredient content of 80% corresponds to an AI value of 0.8. The AI value can be calculated by using techniques such as column chromatography, which can be used to determine the amount of unreacted polyalkene in the final reaction mixture. As a rough approximation, the value of AI is determined after subtracting the percentage of unreacted polyalkene from 100 and divide by 100.

The fuel-soluble product (i) may be formed using ammonia and/or an amine. The amines useful for reacting with the acylating agent to form the product (i) include monoamines, polyamines, and mixtures thereof.

The monoamines have only one amine functionality whereas the polyamines have two or more. The amines may be primary, secondary or tertiary amines. The primary amines are characterized by the presence of at least one —$NH_2$ group; the secondary by the presence of at least one H—N< group. The tertiary amines are analogous to the primary and secondary amines with the exception that the hydrogen atoms in the —$NH_2$ or H—N< groups are replaced by hydrocarbyl groups. Examples of primary and secondary monoamines include ethylamine, diethylamine, n-butylamine, di-n-butylamine, allylamine, isobutylamine, cocoamine, stearylamine, laurylamine, methyllaurylamine, oleylamine, N-methyloctylamine, dodecylamine, and octadecylamine. Suitable examples of tertiary monoamines include trimethylamine, triethylamine, tripropylamine, tributylamine, monomethyldimethylamine, monoethyldimethylamine, dimethylpropylamine, dimethylbutylamine, dimethylpentylamine, dimethylhexylamine, dimethylheptylamine, and dimethyloctylamine.

The amine may be a hydroxyamine. The hydroxyamine may be a primary, secondary or tertiary amine. Typically, the hydroxamines are primary, secondary or tertiary alkanol amines.

The alkanol amines may be represented by the formulae:

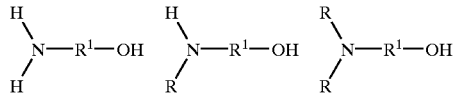

wherein in the above formulae each R is independently a hydrocarbyl group of 1 to about 8 carbon atoms, or a hydroxy-substituted hydrocarbyl group of 2 to about 8 carbon atoms and each R' independently is a hydrocarbylene (i.e., a divalent hydrocarbon) group of 2 to about 18 carbon atoms. The group —R'—OH in such formulae represents the hydroxy-substituted hydrocarbylene group. R' may be an acyclic, alicyclic, or aromatic group. In one embodiment, R' is an acyclic straight or branched alkylene group such as ethylene, 1,2-propylene, 1,2-butylene, 1,2-octadecylene, etc. group. When two R groups are present in the same molecule they may be joined by a direct carbon-to-carbon bond or through a heteroatom (e.g., oxygen, nitrogen or sulfur) to form a 5-, 6-, 7- or 8-membered ring structure. Examples of such heterocyclic amines include N-(hydroxy lower alkyl)-morpholines, -thiomorpholines, -piperidines, -oxazolidines, -thiazolidines and the like. Typically, however, each R is independently a lower alkyl group of up to seven carbon atoms.

Suitable examples of the above hydroxyamines include mono-, di-, and triethanolamine, dimethylethanol amine, diethylethanol amine, di-(3-hydroxy propyl) amine, N-(3-hydroxybutyl) amine, N-(4-hydroxy butyl) amine, and N,N-di-(2-hydroxypropyl) amine.

The amine may be an alkylene polyamine. Especially useful are the alkylene polyamines represented by the formula

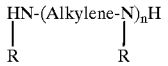

wherein n has an average value between 1 and about 10, and in one embodiment about 2 to about 7, the "Alkylene" group has from 1 to about 10 carbon atoms, and in one embodiment about 2 to about 6 carbon atoms, and each R is independently hydrogen, an aliphatic or hydroxy-substituted aliphatic group of up to about 30 carbon atoms. These alkylene polyamines include methylene polyamines, ethylene polyamines, butylene polyamines, propylene polyamines, pentylene polyamines, etc. Specific examples of such polyamines include ethylene diamine, diethylene triamine, triethylene tetramine, propylene diamine, trimethylene diamine, tripropylene tetramine, tetraethylene pentamine, hexaethylene heptamine, pentaethylene hexamine, or a mixture of two or more thereof.

Ethylene polyamines are useful. These are described in detail under the heading Ethylene Amines in Kirk Othmer's "Encyclopedia of Chemical Technology", 2d Edition, Vol. 7, pages 22–37, Interscience Publishers, New York (1965). These polyamines may be prepared by the reaction of ethylene dichloride with ammonia or by reaction of an ethylene imine with a ring opening reagent such as water, ammonia, etc. These reactions result in the production of a complex mixture of polyalkylene polyamines including cyclic condensation products such as piperazines.

In one embodiment, the amine is a polyamine bottoms or a heavy polyamine. The term "polyamine bottoms" refers to those polyamines resulting from the stripping of a polyamine mixture to remove lower molecular weight polyamines and volatile components to leave, as residue, the polyamine bottoms. In one embodiment, the polyamine bottoms are characterized as having less than about 2% by weight total diethylene triamine or triethylene tetramine. A useful polyamine bottoms is available from Dow Chemical under the trade designation E-100. This material is described as having a specific gravity at 15.6° C. of 1.0168, a nitrogen content of 33.15% by weight, and a viscosity at 40° C. of 121 centistokes. Another polyamine bottoms that may be used is commercially available from Union Carbide under the trade designation HPA-X. This polyamine bottoms product contains cyclic condensation products such as piperazine and higher analogs of diethylene triamine, triethylene tetramine, and the like.

The term "heavy polyamine" refers to polyamines that contain seven or more nitrogen atoms per molecule, or polyamine oligomers containing seven or more nitrogens per molecule, and two or more primary amines per molecule. These are described in European Patent No. EP 0770098, which is incorporated herein by reference for its disclosure of such heavy polyamines.

The fuel-soluble product (i) may be a salt, an ester, an ester/salt, an amide, an imide, or a combination of two or more thereof. The salt may be an internal salt involving residues of a molecule of the acylating agent and the ammonia or amine wherein one of the carboxyl groups becomes ionically bound to a nitrogen atom within the same group; or it may be an external salt wherein the ionic salt group is formed with a nitrogen atom that is not part of the same molecule. In one embodiment, the amine is a hydroxyamine, the hydrocarbyl-substituted carboxylic acid acylating agent is a hydrocarbyl-substituted succinic anhydride, and the resulting fuel-soluble product is a half ester and half salt, i.e., an ester/salt. In one embodiment, the amine is an alkylene polyamine, the hydrocarbyl-substituted carboxylic acid acylating agent is a hydrocarbyl-substituted succinic anhydride, and the resulting fuel-soluble product is a succinimide.

The reaction between the hydrocarbyl-substituted carboxylic acid acylating agent and the ammonia or amine is carried out under conditions that provide for the formation of the desired product. Typically, the hydrocarbyl-substituted carboxylic acid acylating agent and the ammonia or amine are mixed together and heated to a temperature in the range of from about 50° C. to about 250° C., and in one embodiment from about 80° C. to about 200° C.; optionally in the presence of a normally liquid, substantially inert organic liquid solvent/diluent, until the desired product has formed. In one embodiment, the hydrocarbyl-substituted carboxylic acid acylating agent and the ammonia or amine are reacted in amounts sufficient to provide from about 0.3 to about 3 equivalents of hydrocarbyl-substituted carboxylic acid acylating agent per equivalent of ammonia or amine. In one embodiment, this ratio is from about 0.5:1 to about 2:1, and in one embodiment about 1:1.

In one embodiment, the fuel soluble product (i) comprises: (i)(a) a first fuel-soluble product made by reacting a first hydrocarbyl-substituted carboxylic acid acylating agent with ammonia or an amine, the hydrocarbyl substituent of said first acylating agent having about 50 to about 500 carbon atoms; and (i)(b) a second fuel-soluble product made by reacting a second hydrocarbyl-substituted carboxylic acid acylating agent with ammonia or an amine, the hydrocarbyl substituent of said second acylating agent having about 50 to about 500 carbon atoms. In this embodiment, the products (i)(a) and (i)(b) are different. For example, the molecular weight of the hydrocarbyl substituent for the first acylating agent may be different than the molecular weight of the hydrocarbyl substituent for the second acylating agent. In one embodiment, the number average molecular weight for the hydrocarbyl substituent for the first acylating agent may be in the range of about 1500 to about 3000, and in one embodiment about 1800 to about 2300, and the number average molecular weight for the hydrocarbyl substituent for the second acylating agent may be in the range of about 700 to about 1300, and in one embodiment about 800 to about 1000. The first hydrocarbyl-substituted carboxylic acid acylating agent may be a polyisobutene-substituted succinic anhydride, the polyisobutene substituent having a number average molecular weight of about 1500 to about 3000, and in one embodiment about 1800 to about 2300. This first polyisobutene-substituted succinic anhydride may be characterized by at least about 1.3, and in one embodiment about 1.3 to about 2.5, and in one embodiment about 1.7 to about 2.1 succinic groups per equivalent weight of the polyisobutene substituent. The amine used in this first fuel-soluble product (i)(a) may be an alkanol amine and the product may be in the form of an ester/salt. The second hydrocarbyl-substituted carboxylic acid acylating agent may be a polyisobutene-substituted succinic anhydride, the polyisobutene substituent of said second polyisobutene-substituted succinic anhydride having a number average molecular weight of about 700 to about 1300, and in one embodiment about 800 to about 1000. This second polyisobutene-substituted succinic anhydride may be characterized by about 1.0 to about 1.3, and in one embodiment about 1.0 to about 1.2 succinic groups per equivalent weight of the polyisobutene substituent. The amine used in this second fuel-soluble product (i)(b) may be an alkanol amine and the product may be in the form of an ester/salt, or the amine may be an alkylene polyamine and the product may be in the form of a succinimide. The fuel-soluble product (i) may be comprised of: about 1% to about 99% by weight, and in one embodiment about 30% to about 70% by weight of the product (i)(a); and about 99% to about 1% by weight, and in one embodiment about 70% to about 30% by weight of the product (i)(b).

In one embodiment, the fuel soluble product (i) comprises: (i)(a) a first hydrocarbyl-substituted carboxylic acid acylating agent, the hydrocarbyl substituent of said first acylating agent having about 50 to about 500 carbon atoms; and (i)(b) a second hydrocarbyl-substituted carboxylic acid acylating agent, the hydrocarbyl substituent of said second acylating agent having about 50 to about 500 carbon atoms, said first acylating agent and said second acylating agent being the same or different; said first acylating agent and said second acylating agent being coupled together by a linking group derived from a compound having two or more primary amino groups, two or more secondary amino groups, at least one primary amino group and at least one secondary amino group, at least two hydroxyl groups, or at least one primary or secondary amino group and at least one hydroxyl group; said coupled acylating agents being reacted with ammonia or an amine. The molecular weight of the hydrocarbyl substituent for the first acylating agent may be the same as or it may be different than the molecular weight of the hydrocarbyl substituent for the second acylating agent. In one embodiment, the number average molecular weight for the hydrocarbyl substituent for the first and/or second acylating agent is in the range of about 1500 to about 3000, and in one embodiment about 1800 to about 2300. In one embodiment, the number average molecular weight for the hydrocarbyl substituent for the first and/or second acylating agent is in the range of about 700 to about 1300, and in one embodiment about 800 to about 1000. The first and/or second hydrocarbyl-substituted carboxylic acid acylating agent may be a polyisobutene-substituted succinic anhydride, the polyisobutene substituent having a number average molecular weight of about 1500 to about 3000, and in one embodiment about 1800 to about 2300. This first and/or second polyisobutene-substituted succinic anhydride may be characterized by at least about 1.3, and in one embodiment about 1.3 to about 2.5, and in one embodiment about 1.7 to about 2.1 succinic groups per equivalent weight of the polyisobutene substituent. The first and/or second hydrocarbyl-substituted carboxylic acid acylating agent may be a polyisobutene-substituted succinic anhydride, the polyisobutene substituent having a number average molecular weight of about 700 to about 1300, and in one embodiment about 800 to about 1000. This first and/or second polyisobutene-substituted succinic anhydride may be characterized by about 1.0 to about 1.3, and in one embodiment about 1.0 to about 1.2 succinic groups per equivalent weight of the polyisobutene substituent. The linking group may be derived from any of the amines or hydroxamines discussed above having two or more primary amino groups, two or more secondary amino groups, at least one primary amino group and at least one secondary amino group, or at least one primary or secondary amino group and at least one hydroxyl group. The linking group may also be derived from a polyol. The polyol may be a compound represented by the formula $$R—(OH)_m$$

wherein in the foregoing formula, R is an organic group having a valency of m, R is joined to the OH groups through carbon-to-oxygen bonds, and m is an integer from 2 to about 10, and in one embodiment 2 to about 6. The polyol may be a glycol. The alkylene glycols are useful. Examples of the polyols that may be used include ethylene glycol, diethylene glycol, triethylene glycol, tetraethylene glycol, propylene glycol, dipropylene glycol, tripropylene glycol, dibutylene glycol, tributylene glycol, 1,2-butanediol, 2,3-dimethyl-2,3-butanediol, 2,3-hexanediol, 1,2-cyclohexanediol, pentaerythritol, dipentaerythritol, 1,7-heptanediol, 2,4-heptanediol, 1,2,3-hexanetriol, 1,2,4-hexanetriol, 1,2,5-hexanetriol, 2,3,4-hexanetriol, 1,2,3-butanetriol, 1,2,4-butanetriol, 2,2,66-tetrakis-(hydroxymethyl) cyclohexanol, 1,10-decanediol, digitalose, 2-hydroxymethyl-2-methyl-1,3-propanediol (trimethylolethane), or 2-hydroxymethyl-2-ethyl-1,3-propanediol (trimethylopropane), and the like. Mixtures of two or more of the foregoing can be used.

The ratio of reactants utilized in the preparation of these linked products may be varied over a wide range. Generally, for each equivalent of each of the first and second acylating agents, at least about one equivalent of the linking compound is used. The upper limit of linking compound is about two equivalents of linking compound for each equivalent of the first and second acylating agents. Generally the ratio of equivalents of the first acylating agent to the second acylating agent is about 4:1 to about 1:4, and in one embodiment about 1.5:1.

The number of equivalents for the first and second acylating agents is dependent on the total number of carboxylic functions present in each. In determining the number of equivalents for each of the acylating agents, those carboxyl functions that are not capable of reacting as a carboxylic acid acylating agent are excluded. In general, however, there is one equivalent of each acylating agent for each carboxy group in the acylating agents. For example, there would be two equivalents in an anhydride derived from the reaction of one mole of olefin polymer and one mole of maleic anhydride.

The weight of an equivalent of a polyamine is the molecular weight of the polyamine divided by the total number of nitrogens present in the molecule. When the polyamine is to be used as linking compound, tertiary amino groups are not counted. The weight of an equivalent of a commercially available mixture of polyamines can be determined by dividing the atomic weight of nitrogen (14) by the % N contained in the polyamine; thus, a polyamine mixture having a % N of 34 would have an equivalent weight of 41.2. The weight of an equivalent of ammonia or a monoamine is equal to its molecular weight.

The weight of an equivalent of a polyol is its molecular weight divided by the total number of hydroxyl groups present in the molecule. Thus, the weight of an equivalent of ethylene glycol is one-half its molecular weight.

The weight of an equivalent of a hydroxyamine that is to be used as a linking compound is equal to its molecular weight divided by the total number of —OH, >NH and —$NH_2$ groups present in the molecule.

The first and second acylating agents may be reacted with the linking compound according to conventional ester and/or amide-forming techniques. This normally involves heating acylating agents with the linking compound, optionally in the presence of a normally liquid, substantially inert, organic liquid solvent/diluent. Temperatures of at least about 30° C. up to the decomposition temperature of the reaction component and/or product having the lowest such temperature can be used. This temperature may be in the range of about 50° C. to about 130° C., and in one embodiment about 80° C. to about 100° C. when the acylating agents are anhydrides. On the other hand, when the acylating agents are acids, this temperature may be in the range of about 100° C. to about 300° C. with temperatures in the range of about 125° C. to about 250° C. often being employed.

The linked product made by this reaction may be in the form of statistical mixture that is dependent on the charge of each of the acylating agents, and on the number of reactive sites on the linking compound. For example, if an equal molar ratio of the first and second acylating agents is reacted with ethylene glycol, the product would be comprised of a mixture of (1) about 50% of compounds wherein one molecule the first acylating agent is linked to one molecule of the second acylating agent through the ethylene glycol; (2) about 25% of compounds wherein two molecules of the first acylating agent are linked together through the ethylene glycol; and (3) about 25% of compounds wherein two molecules of the second acylating agent are linked together through the ethylene glycol.

The reaction between the linked acylating agents and the ammonia or amine may be carried out under salt, ester/salt, amide or imide forming conditions using conventional techniques. Typically, these components are mixed together and heated to a temperature in the range of about 20ΔC. up to the decomposition temperature of the reaction component and/or product having the lowest such temperature, and in one embodiment about 50° C. to about 130° C., and in one embodiment about 80° C. to about 110° C.; optionally, in the presence of a normally liquid, substantially inert organic liquid solvent/diluent, until the desired salt product has formed.

The following examples are provided to illustrate the preparation of the fuel-soluble products (i) discussed above.

The Ionic or Nonionic Compound (ii)

The ionic or nonionic compound (ii) has a hydrophilic-lipophilic balance (HLB, which refers to the size and strength of the polar (hydrophilic) and non-polar (lipophilic) groups on the surfactant molecule) in the range of about 1 to about 40, and in one embodiment about 4 to about 15. Examples of these compounds are disclosed in *McCutcheon's Emulsifiers and Detergents,* 1998, North American & International Edition. Pages 1–235 of the North American Edition and pages 1–199 of the International Edition are incorporated herein by reference for their disclosure of such ionic and nonionic compounds having an HLB in the range of about 1 to about 40, in one embodiment about 1 to about 30, in one embodiment about 1 to 20, and in another embodiment about 1 to about 10. Useful compounds include alkanolamides, alkylarylsulfonates, amine oxides, poly (oxyalkylene) compounds, including block copolymers comprising alkylene oxide repeat units, carboxylated alcohol ethoxylates, ethoxylated alcohols, ethoxylated alkyl phenols, ethoxylated amines and amides, ethoxylated fatty acids, ethoxylated fatty esters and oils, fatty esters, fatty acid amides, glycerol esters, glycol esters, sorbitan esters, imidazoline derivatives, lecithin and derivatives, lignin and derivatives, monoglycerides and derivatives, olefin sulfonates, phosphate esters and derivatives, propoxylated and ethoxylated fatty acids or alcohols or alkyl phenols, sorbitan derivatives, sucrose esters and derivatives, sulfates or alcohols or ethoxylated alcohols or fatty esters, sulfonates of dodecyl and tridecyl benzenes or condensed naphthalenes or petroleum, sulfosuccinates and derivatives, and tridecyl and dodecyl benzene sulfonic acids.

In one embodiment, the ionic or nonionic compound (ii) is a fuel-soluble product made by reacting an acylating agent having about 12 to about 30 carbon atoms with ammonia or an amine. The acylating agent may contain about 12 to about 24 carbon atoms, and in one embodiment about 12 to about 18 carbon atoms. The acylating agent may be a carboxylic acid or a reactive equivalent thereof. The reactive equivalents include acid halides, anhydrides, esters, and the like. These acylating agents may be monobasic acids or polybasic acids. The polybasic acids are preferably dicarboxylic, although tri- and tetra-carboxylic acids may be used. These acylating agents may be fatty acids. Examples include myristic acid, palmitic acid, stearic acid, oleic acid, linoleic acid, linolenic acid, and the like. These acylating agents may be succinic acids or anhydrides represented, respectively, by the formulae

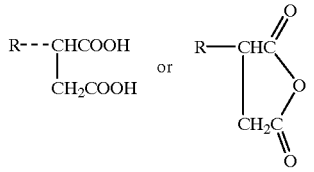

wherein each of the foregoing formulae R is a hydrocarbyl group of about 10 to about 28 carbon atoms, and in one embodiment about 12 to about 20 carbon atoms. Examples include tetrapropylene-substituted succinic acid or anhydride, hexadecyl succinic acid or anhydride, and the like. The amine may be any of the amines described above as being useful in making the fuel-soluble product (i). The product of the reaction between the acylating agent and the ammonia or amine may be a salt, an ester, an amide, an imide, or a combination thereof. The salt may be an internal salt involving residues of a molecule of the acylating agent and the ammonia or amine wherein one of the carboxyl groups becomes ionically bound to a nitrogen atom within the same group; or it may be an external salt wherein the ionic salt group is formed with a nitrogen atom that is not part of the same molecule. The reaction between the acylating agent and the ammonia or amine is carried out under conditions that provide for the formation of the desired product. Typically, the acylating agent and the ammonia or amine are mixed together and heated to a temperature in the range of from about 50° C. to about 250° C., and in one embodiment from about 80° C. to about 200° C.; optionally in the presence of a normally liquid, substantially inert organic liquid solvent/diluent, until the desired product has formed. In one embodiment, the acylating agent and the ammonia or amine are reacted in amounts sufficient to provide from about 0.3 to about 3 equivalents of acylating agent per equivalent of ammonia or amine. In one embodiment, this ratio is from about 0.5:1 to about 2:1, and in one embodiment about 1:1.

In one embodiment, the ionic or nonionic compound (ii) is an ester/salt made by reacting hexadecyl succinic anhydride with dimethylethanol amine in an equivalent ratio (i.e., carbonyl to amine ratio) of about 1:1 to about 1:1.5, and in one embodiment about 1:1.35.

The ionic or nonionic compound (ii) may be present in the water fuel emulsion at a concentration of up to about 15% by weight, and in one embodiment about 0.01 to about 15% by weight, and in one embodiment about 0.01 to about 10% by weight, and one embodiment about 0.01 to about 5% by weight, and in one embodiment about 0.01 to about 3% by weight, and in one embodiment about 0.1 to about 1% by weight.

The Water-Soluble Compound

The water-soluble compound may be an amine salt, ammonium salt, azide compound, nitro compound, alkali metal salt, alkaline earth metal salt, or mixtures of two or more thereof. These compounds are distinct from the fuel-soluble product (i) and the ionic or nonionic compound (ii) discussed above. These water-soluble compounds include organic amine nitrates, nitrate esters, azides, nitramines and nitro compounds. Also included are alkali and alkaline earth metal carbonates, sulfates, sulfides, sulfonates, and the like.

Particularly useful are the amine or ammonium salts represented by the formula $$k[G(NR_3)_y]^{y+}\ nX^{p-}$$

wherein G is hydrogen or an organic group of 1 to about 8 carbon atoms, and in one embodiment 1 to about 2 carbon atoms, having a valence of y; each R independently is hydrogen or a hydrocarbyl group of 1 to about 10 carbon atoms, and in one embodiment 1 to about 5 carbon atoms, and in one embodiment 1 to about 2 carbon atoms; $X^{p-}$ is an anion having a valence of p; and k, y, n and p are independently integers of at least 1. When G is H, y is 1. The sum of the positive charge $ky^+$ is equal to the sum of the negative charge $nX^{p-}$. In one embodiment, X is a nitrate ion; and in one embodiment it is an acetate ion. Examples include ammonium nitrate, ammonium acetate, methylammonium nitrate, methylammonium acetate, ethylene diamine diacetate, urea nitrate, urea and guanidinium nitrate. Ammonium nitrate is particularly useful.

In one embodiment, the water-soluble compound functions as an emulsion stabilizer, i.e., it acts to stabilize the water-fuel emulsion. Thus, in one embodiment, the water-soluble compound is present in the water fuel emulsion in an emulsion stabilizing amount.

In one embodiment, the water-soluble compound functions as a combustion improver. A combustion improver is characterized by its ability to increase the mass burning rate of the fuel composition. The presence of such a combustion improver has the effect of improving the power output of an engine. Thus, in one embodiment, the water-soluble compound is present in the water-fuel emulsion in a combustion-improving amount.

The water-soluble compound may be present in the water-fuel emulsion at a concentration of about 0.001 to about 1% by weight, and in one embodiment from about 0.01 to about 1% by weight.

Cetane Improver

In one embodiment, the water-fuel emulsion contains a cetane improver. The cetane improvers that are useful include but are not limited to peroxides, nitrates, nitrites, nitrocarbamates, and the like. Useful cetane improvers include but are not limited to nitropropane, dinitropropane, tetranitromethane, 2-nitro-2-methyl-1-butanol, 2-methyl-2-nitro-1-propanol, and the like. Also included are nitrate esters of substituted or unsubstituted aliphatic or cycloaliphatic alcohols which may be monohydric or polyhydric. These include substituted and unsubstituted alkyl or cycloalkyl nitrates having up to about 10 carbon atoms, and in one embodiment about 2 to about 10 carbon atoms. The alkyl group may be either linear or branched, or a mixture of linear or branched alkyl groups. Examples include methyl nitrate, ethyl nitrate, n-propyl nitrate, isopropyl nitrate, allyl nitrate, n-butyl nitrate, isobutyl nitrate, sec-butyl nitrate, tert-butyl nitrate, n-amyl nitrate, isoamyl nitrate, 2-amyl nitrate, 3-amyl nitrate, tert-amyl nitrate, n-hexyl nitrate, n-heptyl nitrate, n-octyl nitrate, 2-ethylhexyl nitrate, sec-octyl nitrate, n-nonyl nitrate, n-decyl nitrate, cyclopentyl nitrate, cyclohexyl nitrate, methylcyclohexyl nitrate, and isopropylcyclohexyl nitrate. Also useful are the nitrate esters of alkoxy-substituted aliphatic alcohols such as 2-ethoxyethyl nitrate, 2-(2-ethoxy-ethoxy) ethyl nitrate, 1-methoxypropyl-2-nitrate, 4-ethoxybutyl nitrate, etc., as well as diol nitrates such as 1,6-hexamethylene dinitrate. A useful cetane improver is 2-ethylhexyl nitrate.

The concentration of the cetane improver in the water-fuel emulsion may be at any concentration sufficient to provide the emulsion with the desired cetane number. In one embodiment, the concentration of the cetane improver is at a level of up to about 10% by weight, and in one embodiment about 0.05 to about 10% by weight, and in one embodiment about 0.05 to about 5% by weight, and in one embodiment about 0.05 to about 1% by weight.

Additional Additives

In addition to the foregoing materials, other fuel additives that are well known to those of skill in the art may be used in the water-fuel emulsions of the invention. These include but are not limited to dyes, rust inhibitors such as alkylated succinic acids and anhydrides, bacteriostatic agents, gum inhibitors, metal deactivators, upper cylinder lubricants, and the like. These additional additives may be used at concentrations of up to about 1% by weight based on the total weight of the water-fuel emulsions, and in one embodiment about 0.01 to about 1% by weight.

The total concentration of chemical additives, including the foregoing emulsifiers, in the water-fuel emulsions of the invention may range from about 0.05 to about 30% by weight, and in one embodiment about 0.1 to about 20% by weight, and in one embodiment about 0.1 to about 15% by weight, and in one embodiment about 0.1 to about 10% by weight, and in one embodiment about 0.1 to about 5% by weight.

Organic Solvent

The additives, including the foregoing emulsifiers, may be diluted with a substantially inert, normally liquid organic solvent such as naphtha, benzene, toluene, xylene or diesel fuel to form an additive concentrate which is then mixed with the fuel and water to form the water-fuel emulsion. These concentrates generally contain from about 10% to about 90% by weight of the foregoing solvent.

The water-fuel emulsions may contain up to about 60% by weight organic solvent, and in one embodiment about 0.01 to about 50% by weight, and in one embodiment about 0.01 to about 20% by weight, and in one embodiment about 0.1 to about 5% by weight, and in one embodiment about 0.1 to about 3% by weight.

Antifreeze Agent

In one embodiment, the water-fuel emulsions of the invention contain an antifreeze agent. The antifreeze agent is typically an alcohol. Examples include but are not limited to ethylene glycol, propylene glycol, methanol, ethanol, glycerol and mixtures of two or more thereof. The antifreeze agent is typically used at a concentration sufficient to prevent freezing of the water used in the water-fuel emulsions. The concentration is therefore dependent upon the temperature at which the fuel is stored or used. In one embodiment, the concentration is at a level of up to about 20% by weight based on the weight of the water-fuel emulsion, and in one embodiment about 0.1 to about 20% by weight, and in one embodiment about 1 to about 10% by weight.

What is claimed is:

1. A concentrated aqueous hydrocarbon emulsion comprising:

(1) a portion of a total amount of a hydrocarbon fuel contained in a fully formulated aqueous hydrocarbon fuel emulsion, (2) substantially all of an emulsifier contained in the fully formulated aqueous hydrocarbon fuel emulsion wherein the emulsifier is selected from the group consisting of (i) at least one fuel-soluble product made by reacting at least one hydrocarbyl-substituted carboxylic acid acylating agent with ammonia or an amine, the hydrocarbyl-substituted acylating agent having about 50 to about 500 carbon atoms; (ii) at least one of an ionic or non-ionic compound having a hydrophilic-lipophilic balance of about 1 to about 40; (iii) a mixture of (i) and (ii); or (iv) a water-soluble compound selected from the group consisting of amine salts, ammonium, azide compounds, nitro compounds, nitrate esters, nitramine, alkali metal salts, alkaline earth metal salts and mixtures thereof in combinations with (i), (ii) or (iii); and (3) substantially all of a water contained in the fully formulated aqueous hydrocarbon fuel emulsion wherein the water is selected from the group consisting of water, water antifreeze, water ammonium nitrate, or combinations thereof, resulting in a stable concentrated aqueous hydrocarbon emulsion having a mean particle droplet size of less than or equal to 1 micron used to make the fully formulated aqueous hydrocarbon fuel emulsion.

2. The concentrate of claim 1 wherein the total amount of emulsifier and the total amount of water is contained in the concentrate.

3. The concentrate of claim 1 wherein the portion of the hydrocarbon fuel is in the range of about 0.5% to about 70% by weight of the fully formulated aqueous hydrocarbon fuel.

4. The concentrate of claim 1 wherein the portion of the hydrocarbon fuel is in the range of about 5% to about 40% by weight of the fully formulated aqueous hydrocarbon fuel.

5. The concentrate of claim 1 wherein the portion of the hydrocarbon fuel is in the range of about 1% to about 20% by weight of the fully formulated aqueous hydrocarbon fuel.

6. The concentrate of claim 1 wherein the total amount of emulsifier is in the range of about 0.05% to about 20% by weight of the fully formulated aqueous hydrocarbon fuel emulsion.

7. The concentrate of claim 1 wherein the total amount of emulsifier is in the range of about 0.1% to about 10% by weight of the fully formulated aqueous hydrocarbon fuel emulsion.

8. The concentrate of claim 1 wherein the total amount of emulsifier is in the range of about 0.5% to about 5% by weight of the fully formulated aqueous hydrocarbon fuel emulsion.

9. The concentrate of claim 1 wherein the total amount of water is in the range of about 5% to about 50% by weight of the fully formulated aqueous hydrocarbon fuel emulsion.

10. The concentrate of claim 1 wherein the total amount of water is in the range of about 15% to about 50% by weight of the fully formulated aqueous hydrocarbon fuel emulsion.

11. The concentrate of claim 1 wherein the total amount of water is in the range of about 35% to about 50% by weight of the fully formulated aqueous hydrocarbon fuel emulsion.

12. The concentrate of claim 1 wherein the concentrated aqueous hydrocarbon emulsion has a mean particle droplet size in the range of about 0.1 micron to about 1 micron.

13. The concentrate of claim 1 further comprising additives selected from the group consisting of cetane improvers, organic solvents, antifreeze agents, surfactants and other known fuel additives and combinations thereof.

14. A process for the producing of an aqueous hydrocarbon fuel emulsion from a concentrated aqueous hydrocarbon fuel emulsion comprising:

(1) preparing a concentrated aqueous hydrocarbon fuel emulsion comprising emulsifying;

(a) a portion of a hydrocarbon fuel in the range of about 0.5% to about 70% by weight of the fully formulated aqueous hydrocarbon fuel emulsion;

(b) substantially all of an emulsifier in the range of about 0.05% to about 20% by weight of the fully formulated aqueous hydrocarbon fuel emulsion wherein the emulsifier is selected from the group consisting of (i) at least one fuel-soluble product made by reacting at least one hydrocarbyl-substituted carboxylic acid acylating agent with ammonia or an amine, the hydrocarbyl-substituted acylating agent having about 50 to about 500 carbon atoms; (ii) at least one of an ionic or non-ionic compound having a hydrophilic-lipophilic balance of about 1 to about 40; (iii) a mixture of (i) and (ii); or (iv) a water-soluble compound selected from the group consisting of amine salts, ammonium salts, azide compounds, nitro compounds, nitrate esters, nitramine, alkali metal salts, alkaline earth metal salts and mixtures thereof in combination with (i), (ii) or (iii); and (c) substantially all of a water in the range of about 5% to about 50% by weight of the fully formulated aqueous hydrocarbon fuel emulsion wherein the water is selected from the group consisting of water, antifreeze, ammonium nitrate, and combinations therein, to form a concentrated aqueous hydrocarbon fuel emulsion with a water particle size having a mean diameter of less than 1 micron;

(2) diluting the concentrated aqueous hydrocarbon fuel emulsion with the remaining portion of hydrocarbon fuel in the range of about 95% to about 50% by weight of the total amount of hydrocarbon fuel in the fully formulated aqueous hydrocarbon fuel emulsion, resulting in a stable fully formulated aqueous hydrocarbon fuel emulsion having a mean particle droplet size less than or equal to 1 micron and wherein the fully formulated aqueous hydrocarbon fuel emulsion comprises about 50% to about 99% by weight liquid hydrocarbon fuel and about 1% to about 50% by weight water.

15. The process of claim 14 wherein the final portion of emulsifier and the final portion of water is added to the fully formulated aqueous hydrocarbon fuel emulsion, the hydrocarbon fuel and combination thereof.

16. The process of claim 14 wherein the total amount of emulsifier and the total amount of water is added to the concentrate.

17. The process of claim 14 wherein the portion of hydrocarbon fuel additive used to make the concentrated aqueous hydrocarbon emulsion is in the range of about 0.5% to about 70% by weight of the fully formulated aqueous hydrocarbon emulsion.

18. The process of claim 14 wherein the portion of hydrocarbon fuel additive is used to make the concentrated aqueous hydrocarbon emulsion in the range of about 5% to about 40% by weight of the fully formulated aqueous hydrocarbon emulsion.

19. The process of claim 14 wherein the portion of hydrocarbon fuel additive is used to make the concentrated aqueous hydrocarbon emulsion in the range of about 0.5% to about 20% by weight of the fully formulated aqueous hydrocarbon emulsion.

20. The process of claim 14 wherein the total quantity of emulsifier is used to make the concentrated aqueous hydrocarbon emulsion in the range of about 10% to about 20% by weight of the fully formulated aqueous hydrocarbon fuel product and wherein the water is added in the range of about 5% to about 15% by weight of the fully formulated aqueous hydrocarbon fuel.

21. The process of claim 14 wherein the total quantity of emulsifier is used to make the concentrated aqueous hydrocarbon emulsion in the range of about 0.1% to about 10% by weight of the fully formulated aqueous hydrocarbon fuel product and wherein the water is added in the range of about 15% to about 50% by weight of the fully formulated aqueous hydrocarbon fuel.

22. The process of claim 14 wherein the total quantity of emulsifier is used to make the concentrated aqueous hydrocarbon emulsion in the range of about 0.2% to about 5% by weight of the fully formulated aqueous hydrocarbon fuel product and wherein the water is added in the range of about 35% to about 50% by weight of the fully formulated aqueous hydrocarbon fuel.

23. The process of claim 14 wherein additives are added to the concentrated aqueous hydrocarbon emulsion in the range of about 0.0001% to about 10% by weight of the fully formulated aqueous hydrocarbon fuel emulsion and wherein the additives are selected from the group consisting of cetane improvers, organic solvents, antifreeze agents, surfactants, other known fuel additives and combinations thereof.

24. The process of claim 14 wherein the emulsifying occurs under ambient conditions and results in a concentrated aqueous hydrocarbon emulsion having a mean particle size of less than or equal to 0.1 micron to about 1 micron.

25. The process of claim 14 further comprising the step of diluting the concentrated aqueous hydrocarbon emulsion with the balance of hydrocarbon fuel portion in the range of about 95% to about 40% by weight of the fully formulated aqueous hydrocarbon emulsion.

26. The process of claim 14 further comprising the step of diluting the concentrated aqueous hydrocarbon emulsion with the balance of hydrocarbon fuel portion in the range of about 95% to about 80% by weight of the fully formulated aqueous hydrocarbon emulsion.

27. The process of claim 14 wherein the diluting step occurs by a method selected from the group consisting of mixing, blending, agitation, stirring, emulsification, and combinations thereof.

28. The process of claim 14 the process is selected from a group consisting of a batch process, a continuous process, or combinations thereof.

* * * * *

UNITED STATES PATENT AND TRADEMARK OFFICE

CERTIFICATE OF CORRECTION

PATENT NO. : 6,652,607 B2
DATED : November 25, 2003
INVENTOR(S) : Deborah A. Langer et al.

It is certified that error appears in the above-identified patent and that said Letters Patent is hereby corrected as shown below:

Title page,
Item [75], Inventors, change the spelling of the named inventor to read:
-- Harshida C. Dave --.

Signed and Sealed this

Twenty-seventh Day of April, 2004

JON W. DUDAS
*Acting Director of the United States Patent and Trademark Office*